United States Patent [19]

Sirmay

[11] 4,062,395

[45] Dec. 13, 1977

[54] METHOD OF CASTING AN ASSEMBLY OF ARTICULATABLE COMPONENTS

[76] Inventor: Emil Sirmay, R.D. 1, Box 100-17, Lafayette, N.J. 07848

[21] Appl. No.: 604,106

[22] Filed: Aug. 13, 1975

[51] Int. Cl.[2] ..... B22D 19/12

[52] U.S. Cl. ..... 164/9; 164/108; 164/137; 264/275

[58] Field of Search ..... 164/108, 137, 342, 9; 249/57, 160; 425/330; 264/275

[56] References Cited

U.S. PATENT DOCUMENTS 3,176,357 4/1965 Nelson ..... 249/57

*Primary Examiner*—Robert D. Baldwin
*Attorney, Agent, or Firm*—Thomas N. Neiman

[57] ABSTRACT

The method comprises forming four like, and interfitting molds, with cavities therein, and closing all the molds together in envelopment of a cruciform element. The element, preferably, carries bearings on opposite ends of the pins or shafts thereof. Casting material, such as high tensile bronze is introduced into the molds cavities to cast the end product therein, onto the cruciform element and bearings. The method has particular application and utility in the casting of assemblies of articulatable components, such as universal joints, and the like, in that it affords the fabrication of such assemblies, complete, in a single casting operation. The casting means comprises a mold which is interfittable with others thereof for use in the practice of the above-noted method.

9 Claims, 3 Drawing Figures

① = SWIVEL BODY (YOKE)

② = ROLLER BEARING

③ = CROSS

METHOD OF CASTING AN ASSEMBLY OF ARTICULATABLE COMPONENTS

Figure 1:
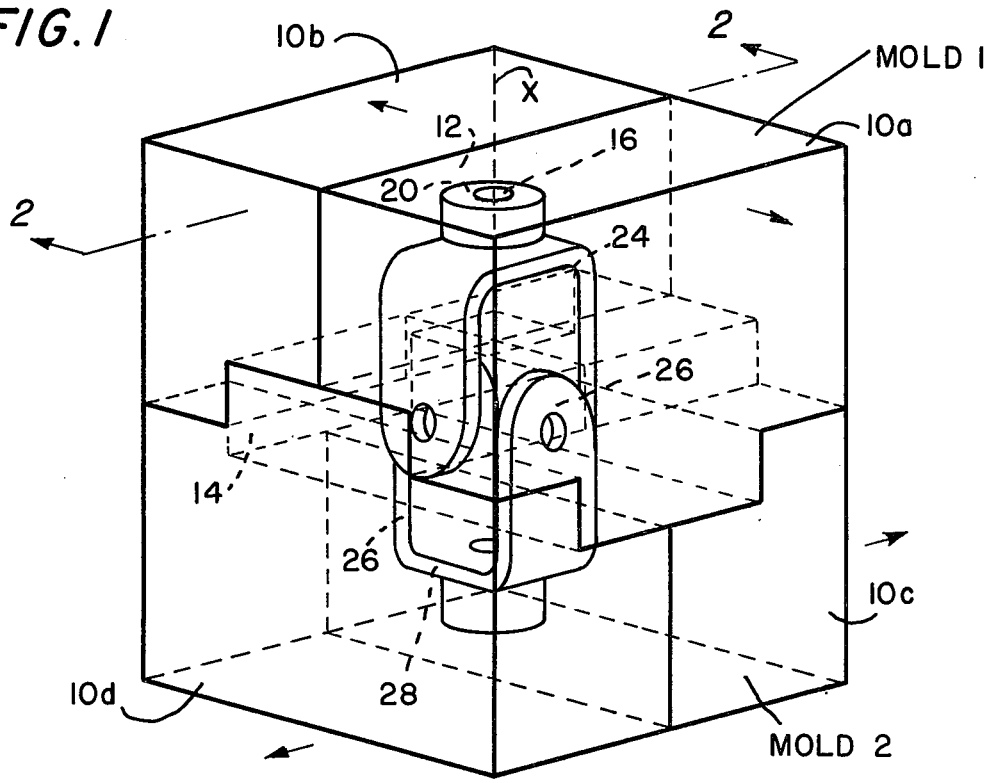

This invention pertains to methods for casting articles, and in particular to methods for casting components used in assemblies which are articulatable in axes, where, according to the teaching of this invention, such assemblies are capable of being cast in a single casting operation. My invention discloses both a methodology for performing such a single casting operation, and casting means usable in such method.

Casting methods known in the prior art, as well as the casting means employed therein, drawn to the purpose of forming components used in assemblies, such as universal joints, and the like, heretofore have required that each of the articulatable and independent components thereof be separately formed. In the known practices of manufacture, components of an articulatable assembly, as — a yoke, for a universal joint — are each formed by forging, the same being independently drilled and bored, trimmed, and machined, and thereafter being assembled, with a cross and bearings, to a like yoke.

The known casting methods, just referenced, yeild a most acceptable articulatable assembly, and the individual casting molds for the independent components of such assemblies are wholly serviceable to these ends. However, the time, the labor, and the costs involved, respecting manpower, machines, and the like, are unduly expensive. What is greatly to be preferred, and what would, therefore, meet a long-felt need, is a method of casting such assemblies of components which are articulatable in a single casting operation, and as a companion need, of course, is a means for casting such assemblies in such a single casting operation.

It is an object of this invention, then, to set forth a method of casting, and means for casting, which will meet the afore-mentioned long-felt need.

Particularly it is an object of this invention to disclose a method of casting, in a single casting operation, an assembly of components which is articulatable in a plurality of axes, comprising the steps of forming a first mold with cavities therein in which to cast a partial cross-section and partial length of a first component of the assembly, and in which to cast a first whole portion of a second component of the assembly; forming a second mold which is a mirror image of said first mold, the second mold having cavities in which to cast a complementary cross-section and a same length of the first component, and in which to cast a second whole portion of said second component; forming third and fourth molds with cavities in which to cast the remaining length of said first component, to complete said first component, and in which to cast complementary cross-sections of said second component which will complement said first and second whole portions and complete said second component; forming an element with a plurality of transversely disposed pins or shafts; supporting said element against movement; closing said molds onto each other and in envelopment of said element; and introducing casting material into said cavities.

It is a further object of this invention to set forth casting means, for use in casting an assembly of components which is articulatable in a plurality of axes, comprising a casting mold having at least one surface with a cavity formed therein; said cavity having a first arcuate portion, and a pair of parallel channels; and wherein said channels are contiguous with said arcuate portion.

Figure 3:
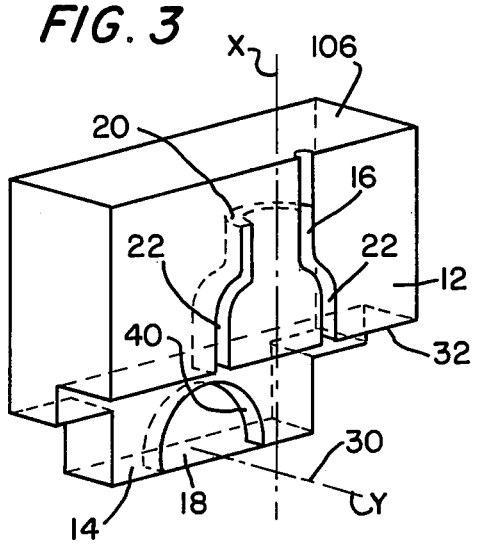
Figure 2:
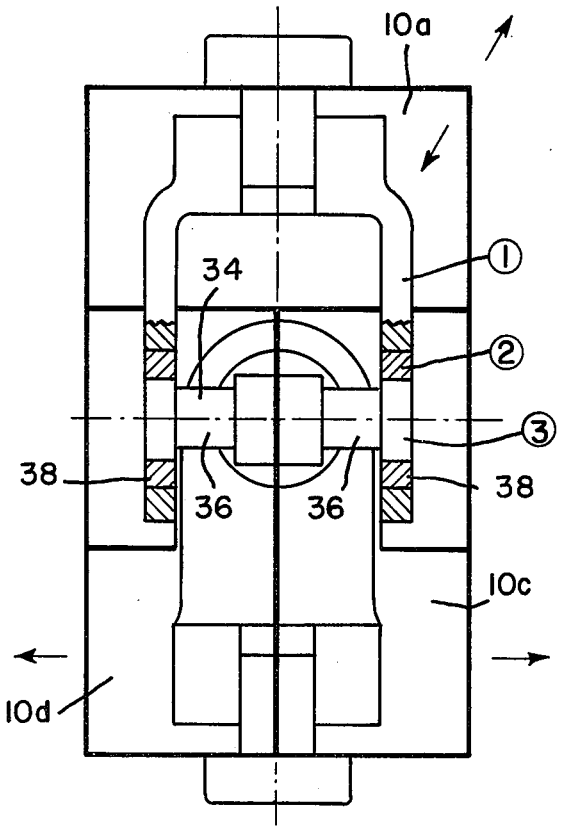

Further objects of this invention, as well as the distinguishing features thereof, will become more apparent by reference to the following description, taken in conjunction with the accompanying figures, in which:

FIG. 1 is an isometric view of four, interfitting casting molds, according to the invention, joined together and enclosing therewithin two yokes and pendent clevises of each, a cross and bearings for the assembly — which, as shown here by way of example, comprises a universal joint — are not shown, and only for illustrative purposes, the casting molds are "transparent" (that the enclosure of the universal joint components might be seen);

FIG. 2 is a cross-sectional view, in elevation, taken along section 2—2 of FIG. 1, showing the cross and bearings within the casting molds and mated to the limbs of the clevises; and FIG. 3 is an isometric projection of one of the casting molds by itself, the same showing the two, independent cavities formed therein.

As shown in the figures, the novel casting method comprises the use of a plurality of casting molds and, in the depicted embodiment, employs four similar casting molds 10*a*, 10*b*, 10*c*, and 10*d*. With particular reference to FIGS. 1 and 2, it can be seen that mold 10*b* has first and second "molding" surfaces 12 and 14 in each of which are formed independent molding cavities 16 and 18. Molding cavity 16 comprises a first arcuate portion 20 which has a radial axis "X" which lies in the plane of surface 12, and a second portion comprises of a pair of parallel channels 22. Channels 22 are contiguous with the arcuate portion 20 of the cavity, these portions of this cavity being formed to cast a cross-sectional portion and a partial length of a first yoke 24. Casting mold 10*b*, in its second molding surface 14 defines the cavity 18 to cast a whole portion of a mating component for the first yoke — to wit, a portion of a limb 26 of a clevis of a second yoke 28. Cavity 18 opens on the second surface 14, of course, but also opens on an underlying, terminal surface 30 — in order that the limb portion will be contiguously formed with the second yoke. So too, a surface 32 which intervenes between the two cavities 16 and 18 has the channels 22 opening thereon — in order that the channels (in which limb portions are partly formed) will be contiguously formed with complementary portions thereof which are formed in molds 10*c* and 10*d* — in the cavities 18 thereof.

As shown, then, and according to the foregoing, each of the molds 10*a*, 10*b*, 10*c*, and 10*d*, has a pair of cavities 16 and 18. Molds 10*a* and 10*b* are mirror images of each other which cooperate to form complementary cross-sections of the first yoke 24 and the teminal ends of limbs 26 of the second yoke 28; both molds are of a vertically "up-right" type, relative to first yoke 24. Molds 10*c* and 10*d* are of a vertically "inverted" type, relative to the second yoke 28; they cooperate to form complementary cross-sections of the second yoke 28, and the terminal ends of the limbs 26 of the first yoke 24.

According to my inventive casting method, a cross or cruciform element 34 is supported (by means not shown) against movement, the molds 10*a* . . . 10*d* are brought into closure with each other, in envelopment of the element, and then casting material is introduced into the cavities 16 and 18. In this manner a complete articulatable assembly, such as a universal joint, is formed in a single casting operation. As for the material, the invention is not limited to any given types. However, it is my proposal to use corrosion-resistant, high-tensile bronze. Obviously, other materials may be used — including sintered materials, by employing such high-compression closure of the molds 10*a*. . . 10*d* onto the element 34 as may be required for such materials.

For light-duty uses, it will be sufficient to form an assembly of articulatable components onto a bare element 34. Such uses would include "universal joints" used in childrens' toy vehicles. For more durable use, however, it will be preferred to fix anti-friction devices on the pins or shafts of the cruciform element 34. Thus, as FIG. 2 illustrates, the pins 36 of the element 34 carry bearings 38 on the ends thereof.

In the practice of my novel method, it is necessary to insure that the pins 36 or bearings 38 are properly aligned in the cavities 18. That is to say: when the molds 10*a* . . . 10*d* are brought into closure with each other, in envelopment of the element 34, it is quite essential that the pins or bearings be in uniformly spaced-apart dispositions relative to the peripheral walls 40 of the cavities 18. Cavities 18, too, have radial axes "Y", which are normal to the plane of surface 12 (and surface 14), and the pins 36 or bearing 38 must be properly centered on these axes "Y".

While I have described my invention in connection with specific embodiments of molding means and molding methods, it is to be clearly understood that this is done only by way of example, and not as a limitation to the scope of my invention as set forth in the objects thereof and in the appended claims.

I claim:

1. A method of casting, in a single casting operation, an assembly of components which is articulatable in a plurality of axes, comprising the steps of:

forming a first mold with cavities shaped to cast a partial cross-section and partial length of a first component of the assembly, and shaped to cast a first whole portion of a second component of the assembly;

forming a second mold which is a mirror image of said first mold, the second mold having cavities shaped to cast a complementary cross-section and a same partial length of the first component, and in which to cast a second whole portion of said second component;

forming third and fourth molds with cavities shaped to cast the remaining length of said first component, to complete said first component, and shaped to cast complementary cross-sections of said second component which will complement said first and second whole portions and complete said second component;

forming an element with a plurality of transversely disposed pins or shafts; supporting said element against movement; closing said molds onto each other and in envelopment of said element; and introducing casting material into said cavities.

2. A method of casting, according to claim 1, wherein the steps of forming said first and second molds comprises forming the cavities therein to cast complementary cross-sections of a first yoke, and whole portions of limbs of a first clevis; and the step of forming said third and fourth molds comprises forming the cavities therein to form complementary cross-sections of a second yoke for contiguous casting thereof with said portions of limbs of said first clevis, and further comprises forming the cavities therein to form portions of limbs of a second clevis for contiguous casting thereof with the cross-sections of the first yoke.

3. A method of casting, according to claim 1, wherein the element-forming step comprises forming said element in cruciform shape, with the pins or shafts thereof disposed in planes perpendicular to each other.

4. A method of casting, according to claim 1, wherein said molds-closing step comprises moving at least one of said first and second molds into closure with the other thereof, and moving at least one of said third and fourth molds into closure with the other thereof.

5. A method of casting, according to claim 1, wherein said molds-closing step comprises:

moving at least one of said first and second molds into closure with the other thereof so that one of the pins or shafts of said element is intruded into the mold cavities for the first and second whole portions of the second component; and moving at least one of said third and fourth molds into closure with the other thereof so that another of the pins or shafts of said element is intruded into the cavities for the remaining length of the first component.

6. A method of casting, according to claim 2, wherein said molds-closing step comprises:

moving at least one of said first and second molds into closure with the other thereof so that one of the pins or shafts of said element is intruded into the cavities for the limbs of the first clevis; and moving at least one of said third and fourth molds into closure with the other thereof so that another of the pins or shafts of said element is intruded into the cavities for the limbs of the second clevis.

7. A method of casting, according to claim 6, further including the step of:

fixing bearings on opposite ends of each of said pins or shafts of said element before closing said molds onto each other and in envelopment of said element.

8. A method of casting, according to claim 7, wherein said molds-closure step further comprises:

closing said molds onto each other so that the bearings are each located in uniformly spaced-apart dispositions relative to peripheral walls of clevis limbs cavities.

9. A method of casting, according to claim 4, wherein said molds-closing step comprises:

moving at least one of said first and second molds in a first direction; and moving at least one of said third and fourth molds in a second direction which is transverse to said first direction.

* * * * *